US008735032B2

(12) United States Patent
Nonaka et al.

(10) Patent No.: US 8,735,032 B2
(45) Date of Patent: May 27, 2014

(54) ELECTROPHOTOGRAPHIC PHOTOSENSITIVE MEMBER, METHOD OF PRODUCING ELECTROPHOTOGRAPHIC PHOTOSENSITIVE MEMBER, PROCESS CARTRIDGE, AND ELECTROPHOTOGRAPHIC APPARATUS

(75) Inventors: Masaki Nonaka, Suntou-gun (JP); Masato Tanaka, Tagata-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 64 days.

(21) Appl. No.: 13/477,821

(22) Filed: May 22, 2012

(65) Prior Publication Data

US 2012/0301178 A1 Nov. 29, 2012

(30) Foreign Application Priority Data

| | | |
|---|---|---|
| May 24, 2011 | (JP) | 2011-115862 |
| May 24, 2011 | (JP) | 2011-115863 |
| Nov. 30, 2011 | (JP) | 2011-262124 |
| Apr. 26, 2012 | (JP) | 2012-100966 |

(51) Int. Cl.
*G03G 5/00* (2006.01)

(52) U.S. Cl.
USPC ..... 430/66; 430/56; 399/159

(58) Field of Classification Search
USPC ..... 430/66, 56; 399/159
See application file for complete search history.

(56) References Cited

U.S. PATENT DOCUMENTS

| | | | |
|---|---|---|---|
| 4,444,863 | A | 4/1984 | Sano |
| 5,035,969 | A | 7/1991 | Kondo |

FOREIGN PATENT DOCUMENTS

| | | | |
|---|---|---|---|
| JP | 63-097959 | A | 4/1988 |
| JP | 2-230254 | A | 9/1990 |
| JP | 2000-066425 | A | 3/2000 |
| JP | 2000-206715 | A | 7/2000 |
| JP | 2000-206716 | A | 7/2000 |
| JP | 2005115353 | A | 4/2005 |
| JP | 2006010816 | A | 1/2006 |
| JP | 2006047949 | A | 2/2006 |
| JP | 2007-279678 | A | 10/2007 |
| JP | 2009015306 | A | 1/2009 |
| JP | 2010085832 | A | 4/2010 |
| JP | 2010156835 | A | 7/2010 |
| JP | 2011175188 | A | 9/2011 |

OTHER PUBLICATIONS

Sharp Technical Journal No. 101, Aug. 2010, Fukushaki gazo furyo no teiryotekina hyoka hoho no kakuritsu (Establishment of quantitative evaluation method of image defects in copying machine).

Frederick D. Lewis, Todd L. Kurth and Weizhong Liu, "Luminescence of extended and folded N,N'-diarylureas", Photochem,Photobiol,Sci.,2002,1,p. 30-37.

Robert A. Batey, V. Santhakumar, Chiaki Yoshina-Ishii, Scott D. Taylor, "An Efficient New Protocol for the Formation of Unsymmetrical Tri- and Tetrasubstituted Ureas",Tetrahedron Letter 39(1998) p. 6267-6270.

(Continued)

*Primary Examiner* — Mark A Chapman
(74) *Attorney, Agent, or Firm* — Canon U.S.A., Inc., IP Division

(57) ABSTRACT

An electrophotographic photosensitive member having a surface layer that contains a polymer produced by the polymerization of a compound having a chain-polymerizable functional group. The compound having a chain-polymerizable functional group is a compound represented by the formula (1).

11 Claims, 2 Drawing Sheets

(56) References Cited

OTHER PUBLICATIONS

Kin-ya Akiba, Satoru Matsunami, Chikahiko Eguchi, and Naoki Inamoto, "Chemistry of Nitrosoimines. VI. Attempted Syntheses of Some Resonance Stabilized Nitrosoimines and Their UV Spectra", Bulletin of the Chemical Society of Japan,vol. 47(4),1974, p. 935-937.

Ernst Bergmann and A. Weitzmann, "The Structure of Urea and Its Derivatives" Transaction of the Faraday Society,34,1938,p. 783-786.

U.S. Appl. No. 13/477,492, filed May 22, 2012, Hideaki Nagasaka.

U.S. Appl. No. 13/477,561, filed May 22, 2012, Hideaki Nagasaka.

U.S. Appl. No. 13/477,410, filed May 22, 2012, Masato Tanaka.

U.S. Appl. No. 13/477,876, filed May 22, 2012, Masaki Nonaka.

ELECTROPHOTOGRAPHIC PHOTOSENSITIVE MEMBER, METHOD OF PRODUCING ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

The present invention relates to an electrophotographic photosensitive member, a method of producing the electrophotographic photosensitive member, a process cartridge, and an electrophotographic apparatus.

2. Description of the Related Art

In recent years, for the purpose of extending the life of an electrophotographic photosensitive member, improving image quality, and increasing the processing speed of an electrophotographic apparatus, it has been desired to improve the mechanical durability (abrasion resistance) of an organic electrophotographic photosensitive member containing an organic photoconductive substance (charge generating substance) (hereinafter referred to as an "electrophotographic photosensitive member"). In order to improve the mechanical durability, in accordance with one technique, a surface layer of an electrophotographic photosensitive member contains a polymer produced by the polymerization of a compound having a polymerizable functional group.

Japanese Patent Laid-Open No. 2000-066425 discloses a technique for providing a surface layer with a polymer produced by the polymerization of a charge transporting substance having two or more chain-polymerizable functional groups to improve the abrasion resistance and the electric potential stability of an electrophotographic photosensitive member. Japanese Patent Laid-Open No. 2010-156835 discloses a technique for providing a surface layer with a charge transporting substance having two or more methacryloyl groups per molecule and a polymer of a composition containing no polymerization initiator to improve the mechanical durability (abrasion resistance) and the electric potential stability of an electrophotographic photosensitive member.

However, with an improvement in the mechanical durability (abrasion resistance) of an electrophotographic photosensitive member by these techniques, image deletion is more likely to occur.

Image deletion is a phenomenon in which a blurred electrostatic latent image results in a blurred output image. It is believed that the reason for image deletion is that discharge products resulting from charging remaining on the surface of an electrophotographic photosensitive member decrease the surface resistance of the electrophotographic photosensitive member.

The present inventors found that the technique described in Japanese Patent Laid-Open No. 2010-156835 tends to cause distortion of a charge transporting substance, resulting in insufficient electric potential stability and prevention of image deletion in repeated use.

The present inventors also found that, among the chain-polymerizable charge transporting substances described in Japanese Patent Laid-Open No. 2000-066425, a charge transporting substance having a methacryloyloxy group has a higher image deletion preventing effect than a charge transporting substance having an acryloyloxy group but has more room for improvement in terms of image deletion and electric potential stability.

Japanese Patent Laid-Open No. 2007-279678 discloses a technique for preventing image deletion by providing a surface layer containing a curable resin of an electrophotographic photosensitive member with a particular amine compound. However, the image deletion preventing effect is insufficient, and the electric potential stability of the electrophotographic photosensitive member tends to deteriorate.

SUMMARY OF THE INVENTION

The present invention provides an electrophotographic photosensitive member having a surface layer that contains a polymer produced by the polymerization of a compound having a chain-polymerizable functional group. The electrophotographic photosensitive member has excellent electric potential stability and reduces image deletion in repeated use. The present invention also provides a method of producing the electrophotographic photosensitive member. The present invention also provides a process cartridge and an electrophotographic apparatus each including the electrophotographic photosensitive member.

These can be achieved by the present invention.

The present invention relates to an electrophotographic photosensitive member that includes a support and a photosensitive layer provided on the support. The electrophotographic photosensitive member includes a surface layer that contains a polymer obtainable by the polymerization of a compound having one or more chain-polymerizable functional groups. The compound having the chain-polymerizable functional groups is a compound represented by the following formula (1).

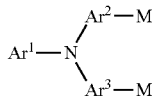

(1)

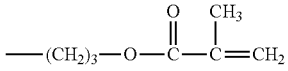

(M)

In the formula (1), $Ar^1$ represents a substituted or unsubstituted phenyl group. $Ar^2$ and $Ar^3$ each independently represents a substituted or unsubstituted phenylene group. M is a group represented by the above formula (M). A substituent group of the substituted phenyl group and a substituent group of the substituted phenylene group are a methyl group, an ethyl group, a n-propyl group, a methoxy group, an ethoxy group, a propoxy group, a fluorine atom, a chlorine atom, or a bromine atom.

The present invention relates to a method of producing the electrophotographic photosensitive member, which involves forming a coat by the use of a surface-layer coating solution containing a compound represented by the formula (1) and forming the surface layer by the polymerization of the compound represented by the formula (1) contained in the coat.

The present invention relates to a process cartridge detachably attachable to the main body of an electrophotographic apparatus. The process cartridge integrally supports the electrophotographic photosensitive member and at least one device selected from the group consisting of a charging device, a developing device, a transferring device, and a cleaning device.

The present invention also relates to an electrophotographic apparatus that includes the electrophotographic photosensitive member, a charging device, an exposure device, a developing device, and a transferring device.

The present invention provides an electrophotographic photosensitive member having a surface layer that contains a polymer produced by the polymerization of a compound having a chain-polymerizable functional group. The electrophotographic photosensitive member has excellent electric potential stability and reduces image deletion in repeated use. The present invention also provides a method of producing the electrophotographic photosensitive member. The present invention can also provide a process cartridge and an electrophotographic apparatus each including the electrophotographic photosensitive member.

Further features of the present invention will become apparent from the following description of exemplary embodiments with reference to the attached drawings.

DESCRIPTION OF THE EMBODIMENTS

Figure 1A:
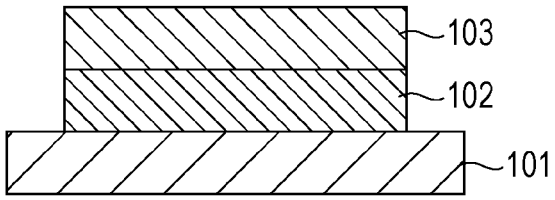
FIGS. 1A and 1B are schematic views of the layer structure of an electrophotographic photosensitive member according to an embodiment of the present invention.

As described above, an electrophotographic photosensitive member according to an embodiment of the present invention includes a surface layer that contains a polymer produced by the polymerization of a compound having one or more chain-polymerizable functional groups. The compound having one or more chain-polymerizable functional groups is a compound represented by the formula (1).

An electrophotographic photosensitive member according to the present invention has excellent electric potential stability and reduces image deletion. The present inventors believe the reason for this as follows.

The compound represented by the formula (1) is a charge transporting substance having two methacryloyloxy groups. In the presence of many radicals during a polymerization reaction, the methacryloyloxy groups can rapidly react with each other to form a polymer with high polymerization efficiency. However, rapid polymerization of the methacryloyloxy groups tends to cause distortion of a charge transporting structure of the charge transporting substance, resulting in a polymer partly having reduced polymerization efficiency. This tends to cause the deposition of a discharge product on a portion having reduced polymerization efficiency, resulting in image deletion.

The distortion of a charge transporting structure of the charge transporting substance may result in different oxidation potentials of the charge transporting structure or different charge mobilities in the fine structure of the charge transporting substance, thus decreasing electric potential stability.

The present inventors found that the presence of an alkylene group between the charge transporting structure and the chain-polymerizable functional group as described in Japanese Patent Laid-Open No. 2009-015306 is insufficient to prevent image deletion. An excessively large number of carbon atoms of the alkylene group results in a decrease in cross-linking density (the density of the three-dimensional network structure), thus causing image deletion.

Thus, the present inventors found that, in order to prevent image deletion, the alkylene group between the charge transporting structure and the chain-polymerizable functional group (a methacryloyloxy group) should have a length most suitable for the skeleton, the substituent group, or the size of the charge transporting structure. More specifically, use of a n-propylene group as the alkylene group can reduce the distortion of a charge transporting structure of the charge transporting substance and provide a surface layer having a high cross-linking density, thus preventing image deletion and improving electric potential stability.

A surface layer according to an embodiment of the present invention contains a polymer produced by the polymerization of a compound represented by the following formula (1).

(1)

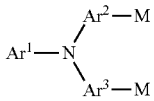

(M)

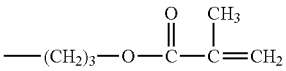

In the formula (1), $Ar^1$ represents a substituted or unsubstituted phenyl group. $Ar^2$ and $Ar^3$ each independently represents a substituted or unsubstituted phenylene group. M is a group represented by the above formula (M). A substituent group of the substituted phenyl group and a substituent group of the substituted phenylene group are a methyl group, an ethyl group, a n-propyl group, a methoxy group, an ethoxy group, a propoxy group, a fluorine atom, a chlorine atom, or a bromine atom. The presence of a substituent group other than these substituent groups may cause steric hindrance in the polymerization reaction, result in the formation of a polymer having reduced polymerization efficiency, and tend to cause image deletion. The electric potential stability can be improved when $Ar^1$ is a methyl-substituted phenyl group or a phenyl group.

When the alkylene group between each of the methacryloyloxy groups and the charge transporting structure (a triphenylamine structure) has two or less carbon atoms (an ethylene group, a methylene group, or a single bond), the length of the alkylene group is insufficient for the size of the triphenylamine structure. Thus, the polymerization tends to proceed while the charge transporting structure is distorted and yield a polymer having reduced polymerization efficiency, thus causing image deletion. On the other hand, when the alkylene group has four or more carbon atoms (a n-butylene group or the like), the cross-linking density decreases, and image deletion tends to occur. When the alkylene group has a still larger number of carbon atoms, the proportion of the charge transporting structure in the surface layer decreases, and therefore the electric potential stability tends to decrease. In addition, an oxygen atom or a phenylene group between the alkylene groups and the methacryloyloxy group can be a starting point of a cleavage in a polymerization reaction, resulting in polymerization while the charge transporting structure is distorted. This tends to cause image deletion and decrease electric potential stability.

A surface layer of an electrophotographic photosensitive member may be formed using one or two or more compounds represented by the formula (1).

A compound represented by the formula (1) according to an embodiment of the present invention may be synthesized by a method described in Japanese Patent Laid-Open No. 2010-156835.

The following are examples of a compound represented by the formula (1). However, the present invention is not limited to these examples.

(1-1)
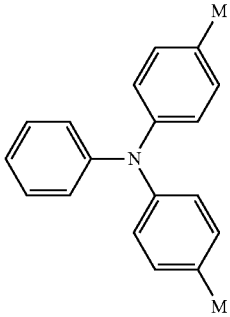
(1-2)
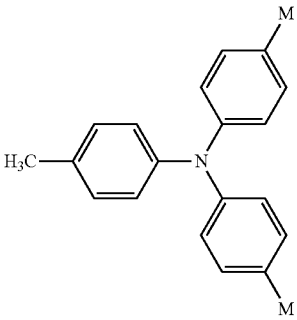
(1-3)
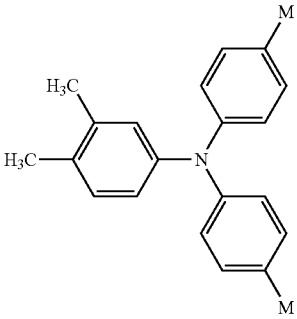
(1-4)
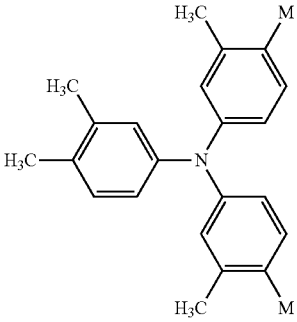
(1-5)
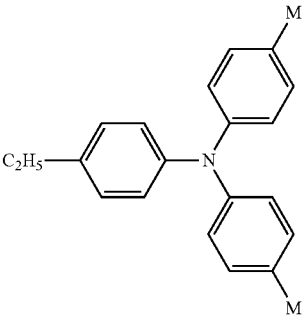
-continued
(1-6)
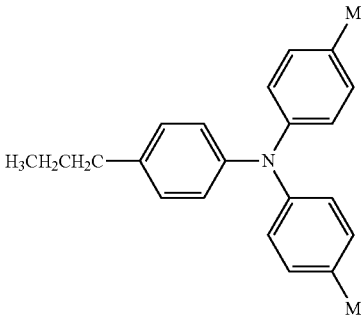
(1-7)
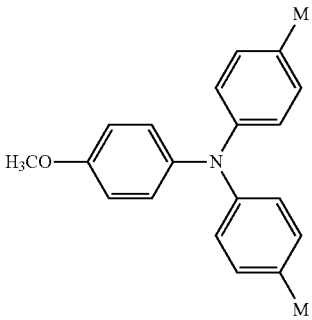
(1-8)
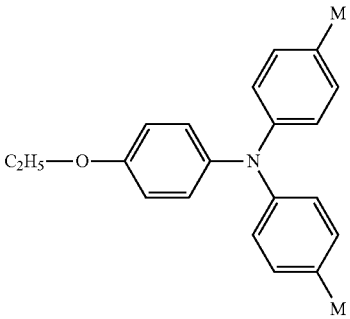
(1-9)
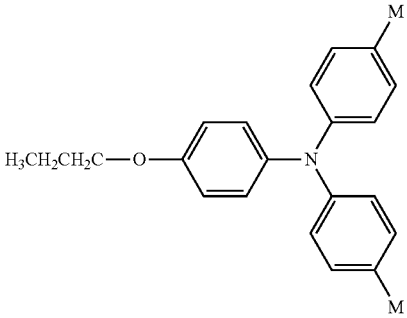
(1-10)
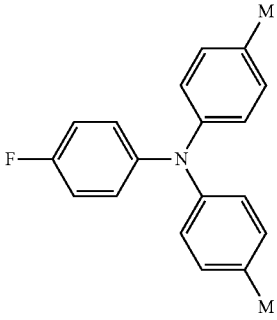

-continued
(1-11)
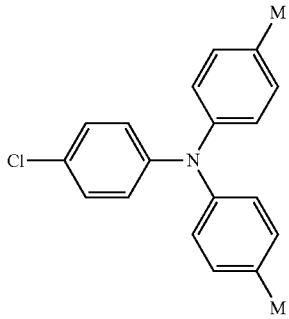
(1-12)
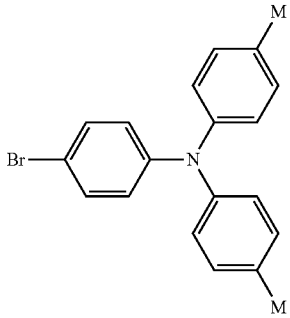
(1-13)
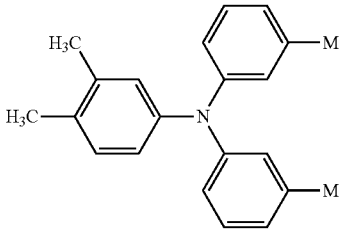
(1-14)
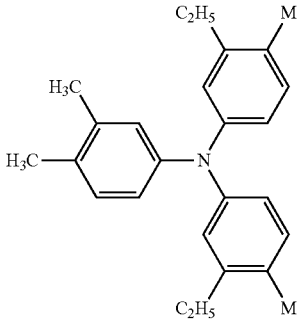
(1-15)
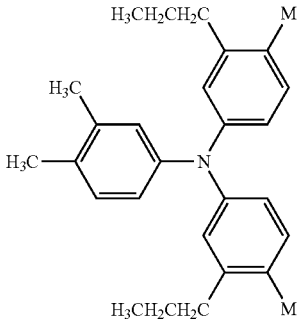
-continued
(1-16)
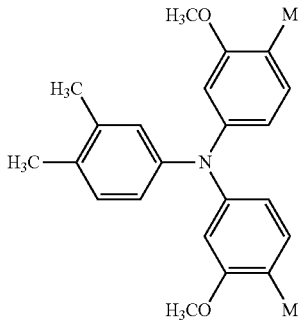
(1-17)
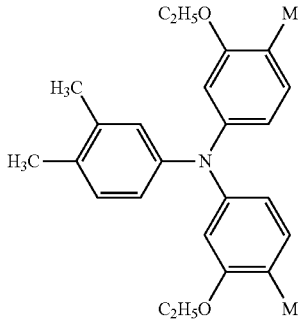
(1-18)
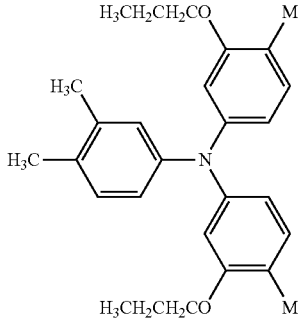
(1-19)
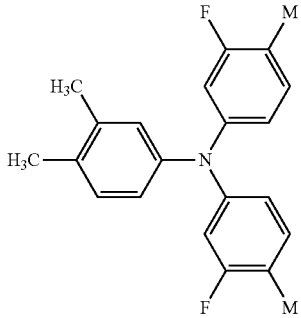
(1-20)
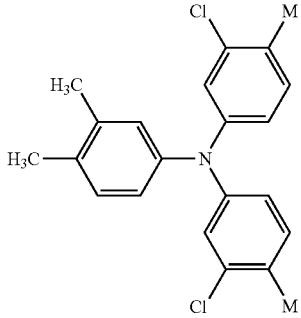

-continued (1-21)

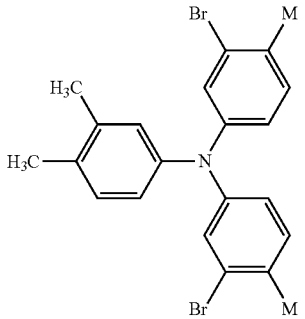

(1-22)

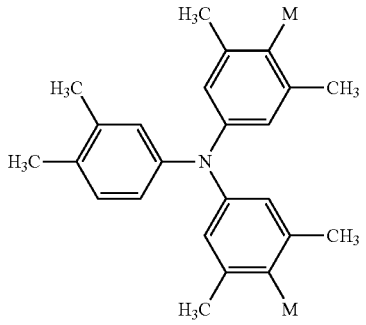

Use of the exemplary compounds (1-1), (1-2), and (1-3) can improve the electric potential stability and the image deletion preventing effect.

The photosensitive layer may be a monolayer photosensitive layer that contains a charge generating substance and a charge transporting substance or a multilayer (function-separated) photosensitive layer that includes a charge generating layer containing a charge generating substance and a charge transporting layer containing a charge transporting substance. An electrophotographic photosensitive member according to an embodiment of the present invention can have a multilayer photosensitive layer. The charge transporting layer may also have a multilayer structure. The charge transporting layer may be covered with a protective layer.

Figure 1B:
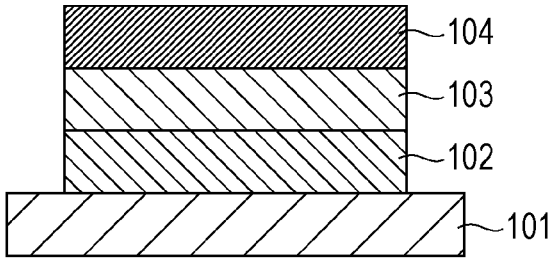

FIGS. 1A and 1B are schematic views of the layer structure of an electrophotographic photosensitive member according to an embodiment of the present invention. The layer structures include a support 101, a charge generating layer 102, a charge transporting layer 103, and a protective layer (second charge transporting layer) 104. If necessary, an undercoat layer may be disposed between the support 101 and the charge generating layer 102. The term "a surface layer of an electrophotographic photosensitive member", as used herein, refers to the outermost layer. In an electrophotographic photosensitive member having the layer structure illustrated in FIG. 1A, the surface layer of the electrophotographic photosensitive member is the charge transporting layer 103. In an electrophotographic photosensitive member having the layer structure illustrated in FIG. 1B, the surface layer of the electrophotographic photosensitive member is the protective layer (second charge transporting layer) 104.

An electrophotographic photosensitive member according to an embodiment of the present invention can be produced by a method that involves forming a coat by the use of a surface-layer coating solution containing a compound represented by the formula (1) and forming a surface layer by the polymerization of the compound represented by the formula (1) contained in the coat.

The polymer contained in a surface layer of an electrophotographic photosensitive member according to an embodiment of the present invention may be a polymer produced by the polymerization of a composition that contains a compound represented by the formula (1) and another compound having a methacryloyloxy group. Use of a compound represented by the following formula (A) (an adamantane compound) as another compound having a methacryloyloxy group can prevent microaggregation of the charge transporting structure of a compound represented by the formula (1) and make a polymerization reaction uniform. A compound represented by the following formula (B) and a compound represented by the following formula (C) (a urea compound) have an image deletion preventing effect without inhibiting the polymerization reaction.

(A)

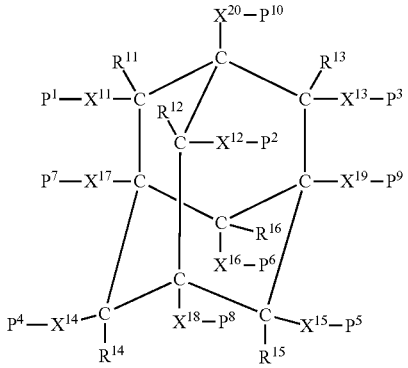

In the formula (A), $R^{11}$ to $R^{16}$ each independently represents a hydrogen atom, a methyl group, an ethyl group, a n-propyl group, a trifluoromethyl group, a hydroxy group, a methoxy group, an ethoxy group, an amino group, a dimethylamino group, a trimethylsilyl group, a fluorine atom, a chlorine atom, or a bromine atom. $X^{11}$ to $X^{20}$ each independently represents a single bond or an alkylene group. $P^1$ to $P^{10}$ each independently represents a hydrogen atom, a methyl group, an ethyl group, a n-propyl group, a trifluoromethyl group, a hydroxy group, a methoxy group, an ethoxy group, an amino group, a dimethylamino group, a trimethylsilyl group, a fluorine atom, a chlorine atom, a bromine atom, or a methacryloyloxy group. When $X^{11}$ is a single bond, $P^1$ and $R^{11}$ may combine to form an oxo group (=O). When $X^{12}$ is a single bond, $P^2$ and $R^{12}$ may combine to form an oxo group (=O). When $X^{13}$ is a single bond, $P^3$ and $R^{13}$ may combine to form an oxo group (=O). When $X^{14}$ is a single bond, $P^4$ and $R^{14}$ may combine to form an oxo group (=O). When $X^{15}$ is a single bond, $P^5$ and $R^{15}$ may combine to form an oxo group (=O). When $X^{16}$ is a single bond, $P^6$ and $R^{16}$ may combine to form an oxo group (=O). At least one of $P^1$ to $P^{10}$ is a methacryloyloxy group. When $P^1$ is a methacryloyloxy group, $R^{11}$ is a hydrogen atom. When $P^2$ is a methacryloyloxy group, $R^{12}$ is a hydrogen atom. When $P^3$ is a methacryloyloxy group, $R^{13}$ is a hydrogen atom. When $P^4$ is a methacryloyloxy group, $R^{14}$ is a hydrogen atom. When $P^5$ is a methacryloyloxy group, $R^{15}$ is a hydrogen atom. When $P^6$ is a methacryloyloxy group, $R^{16}$ is a hydrogen atom.

(B)

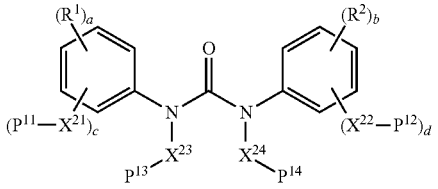

-continued (C)

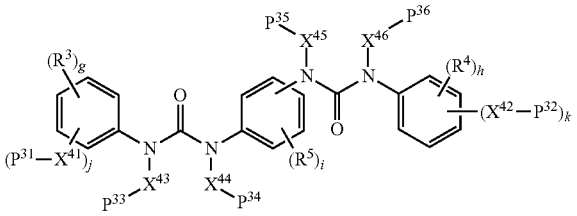

In the formulas (B) and (C), $R^1$ to $R^5$ each independently represents a methyl group, an ethyl group, a n-propyl group, a methoxymethyl group, a trifluoromethyl group, a trichloromethyl group, a methoxy group, an ethoxy group, a propoxy group, a methoxymethoxy group, a trifluoromethoxy group, a trichloromethoxy group, a dimethylamino group, or a fluorine atom. $X^{21}$ to $X^{24}$ and $X^{41}$ to $X^{46}$ each independently represents an alkylene group. $P^{11}$ to $P^{14}$ and $P^{31}$ to $P^{36}$ each independently represents a hydrogen atom or a methacryloyloxy group, and at least one of $P^{11}$ to $P^{14}$ and at least one of $P^{31}$ to $P^{36}$ each independently represents a methacryloyloxy group. a, b, g, and h each independently represents an integer number selected from 0 to 5, and i represents an integer number selected from 0 to 4. c, d, j, and k each independently represents 0 or 1.

A surface layer of an electrophotographic photosensitive member according to an embodiment of the present invention may contain various additive agents. Examples of the additive agents include, but are not limited to, antidegradants, such as antioxidants and ultraviolet absorbers, lubricants, such as polytetrafluoroethylene (PTFE) resin fine particles and fluorocarbons, and polymerization control agents, such as polymerization initiators and polymerization terminators. A compound represented by the following formula (D), (E), or (F) (a urea compound) in the surface layer has an image deletion preventing effect without inhibiting the polymerization reaction.

(D)

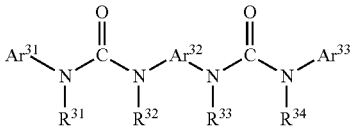

(E)

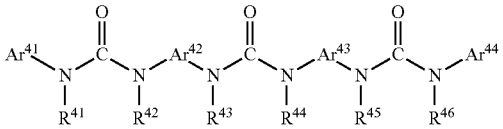

(F)

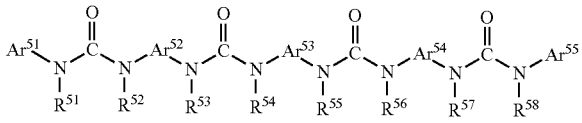

In the formulas (D), (E) and (F), $R^{31}$ to $R^{34}$, $R^{41}$ to $R^{46}$, and $R^{51}$ to $R^{58}$ each independently represents an alkyl group. $Ar^{32}$, $Ar^{42}$ and $Ar^{43}$, and $Ar^{52}$ to $Ar^{54}$ each independently represents a substituted or unsubstituted arylene group. A substituent group of the substituted arylene group may be an alkyl group, an alkoxy-substituted alkyl group, a halogen-substituted alkyl group, an alkoxy group, an alkoxy-substituted alkoxy group, a halogen-substituted alkoxy group, or a halogen atom. $Ar^{31}$, $Ar^{33}$, $Ar^{41}$, $Ar^{44}$, $Ar^{51}$, and $Ar^{55}$ each independently represents a substituted or unsubstituted aryl group or a fused ring. A substituent group of the substituted aryl group may be a carboxy group, a cyano group, a dialkylamino group, a hydroxy group, an alkyl group, an alkoxy-substituted alkyl group, a halogen-substituted alkyl group, an alkoxy group, an alkoxy-substituted alkoxy group, a halogen-substituted alkoxy group, a nitro group, or a halogen atom.

The surface layer may contain at least one compound selected from the group consisting of a compound represented by the following formula (G) and a compound represented by the following formula (H). These compounds can deactivate a large number of radicals derived from a methacryloyloxy group of a compound represented by the formula (1) and control the reaction between the methacryloyloxy groups, thus further reducing distortion of a charge transporting structure and image deletion. In order to control the polymerization reaction, the amount of compound represented by the following formula (G) and compound represented by the following formula (H) is 5 ppm or more and 1500 ppm or less, preferably 5 ppm or more and 100 ppm or less, more preferably 10 ppm or more and 90 ppm or less, of the total mass of the polymer.

(G)

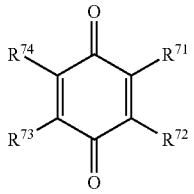

(H)

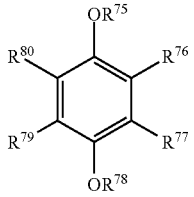

In the formulas (G) and (H), $R^{71}$ to $R^{74}$, $R^{76}$, $R^{77}$, $R^{79}$, and $R^{80}$ each independently represents a hydrogen atom, a hydroxy group, a substituted or unsubstituted alkyl group, a substituted or unsubstituted aryl group, or a substituted or unsubstituted alkoxy group. At least one of $R^{71}$ and $R^{74}$, at least one of $R^{72}$ and $R^{73}$, at least one of $R^{76}$ and $R^{80}$, and at least one of $R^{77}$ and $R^{79}$ each independently represents a hydrogen atom, a methyl group, or a hydroxy group. $R^{75}$ and $R^{78}$ each independently represents a hydrogen atom, a substituted or unsubstituted alkyl group, or a substituted or unsubstituted aryl group, and at least one of $R^{75}$ and $R^{78}$ is a hydrogen atom. A substituent group of the substituted alkyl group, a substituent group of the substituted aryl group, and a substituent group of the substituted alkoxy group may be a carboxy group, a cyano group, a dialkylamino group, a hydroxy group, an alkyl group, an alkoxy-substituted alkyl group, a halogen-substituted alkyl group, an alkoxy group, an alkoxy-substituted alkoxy group, a halogen-substituted alkoxy group, a nitro group, or a halogen atom.

Examples of the compound represented by the formula (G) include, but are not limited to, benzoquinones, such as p-benzoquinone, 2,6-dimethyl-p-benzoquinone, methyl-p-benzoquinone, and tert-butyl-p-benzoquinone. Examples of the compound represented by the formula (H) include, but are not limited to, hydroquinone monomethyl ether, hydroquinone, and 2,5-bis(tert-butyl)-1,4-benzenediol.

In the formula (H), $R^{75}$ may be a hydrogen atom, and $R^{78}$ may be a substituted or unsubstituted alkyl group or a substituted or unsubstituted aryl group. $R^{78}$ may be a methyl group; more specifically, the compound represented by the formula (H) may be hydroquinone monomethyl ether.

Examples of an alkyl group in the compounds represented by the formulas (A) to (H) include, but are not limited to, a methyl group, an ethyl group, and a n-propyl group. Examples of an alkylene group in these compounds include, but are not limited to, a methylene group, an ethylene group, and a n-propylene group. Examples of an alkoxy-substituted alkyl group in these compounds include, but are not limited to, a methoxymethyl group and an ethoxymethyl group. Examples of a halogen-substituted alkyl group in these compounds include, but are not limited to, a trifluoromethyl group and a trichloromethyl group. Examples of an alkoxy group in these compounds include, but are not limited to, a methoxy group and an ethoxy group. Examples of an alkoxy-substituted alkoxy group in these compounds include, but are not limited to, a methoxymethoxy group and an ethoxymethoxy group. Examples of a halogen-substituted alkoxy group in these compounds include, but are not limited to, a trifluoromethoxy group and a trichloromethoxy group. Examples of a halogen atom in these compounds include, but are not limited to, a fluorine atom, a chlorine atom, and a bromine atom. Examples of a dialkylamino group in these compounds include, but are not limited to, a dimethylamino group and a diethylamino group.

Examples of the solvent of the surface-layer coating solution include, but are not limited to, alcohol solvents, such as methanol, ethanol, and propanol, ketone solvents, such as acetone, methyl ethyl ketone, and cyclohexanone, ester solvents, such as ethyl acetate and butyl acetate, ether solvents, such as tetrahydrofuran and dioxane, halogen solvents, such as 1,1,2,2,3,3,4-heptafluorocyclopentane, dichloromethane, dichloroethane, and chlorobenzene, aromatic solvents, such as benzene, toluene, and xylene, and cellosolve solvents, such as methyl cellosolve and ethyl cellosolve. These solvents may be used alone or in combination.

The structure of an electrophotographic photosensitive member according to an embodiment of the present invention will be described below.

Support

A support for use in an electrophotographic photosensitive member according to an embodiment of the present invention may be a support having high electrical conductivity (electroconductive support), for example, made of aluminum, an aluminum alloy, or stainless steel. An aluminum or aluminum alloy support may be an ED tube, an EI tube, or a support manufactured by cutting, electrochemical mechanical polishing, or wet or dry honing of these tubes. A metal support or a resin support may be covered with a thin film, for example, made of aluminum, an aluminum alloy, or an electroconductive material, such as an indium oxide-tin oxide alloy. The surface of the support may be subjected to cutting, surface roughening, or alumite treatment.

The support may contain electroconductive particles, such as carbon black, tin oxide particles, titanium oxide particles, or silver particles, dispersed in a resin. The support may also be a plastic containing an electroconductive binder resin.

In an electrophotographic photosensitive member according to an embodiment of the present invention, an electroconductive layer containing electroconductive particles and a resin may be formed on the support. In a method for forming an electroconductive layer containing electroconductive particles and a resin on the support, the electroconductive layer contains a powder containing electroconductive particles. Examples of the electroconductive particles include, but are not limited to, carbon black, acetylene black, powders of aluminum, nickel, iron, nichrome, copper, zinc, silver, and other metals, and powders of metal oxides, such as electroconductive tin oxide and indium-tin oxide (ITO).

Examples of the resin for use in the electroconductive layer include, but are not limited to, acrylic resin, alkyd resin, epoxy resin, phenolic resin, butyral resin, polyacetal resin, polyurethane, polyester, polycarbonate, and melamine resin.

Examples of the solvent for use in the electroconductive-layer coating solution include, but are not limited to, ether solvents, alcohol solvents, ketone solvents, and aromatic hydrocarbon solvents. The thickness of the electroconductive layer is preferably 0.2 μm or more and 40 μm or less, more preferably 5 μm or more and 40 μm or less.

An electrophotographic photosensitive member according to an embodiment of the present invention may include an undercoat layer between the support or the electroconductive layer and the photosensitive layer. The undercoat layer may be formed by applying an undercoat layer coating solution containing a resin to the support or the electroconductive layer and drying or hardening the coating solution.

Examples of the resin for use in the undercoat layer include, but are not limited to, poly(acrylic acid), methylcellulose, ethylcellulose, polyamide resin, polyimide resin, polyamideimide resin, poly(amic acid) resin, melamine resin, epoxy resin, and polyurethane resin. The undercoat layer may contain the electroconductive particles described above.

Examples of the solvent for use in the undercoat layer coating solution include, but are not limited to, ether solvents, alcohol solvents, ketone solvents, and aromatic hydrocarbon solvents. The thickness of the undercoat layer is preferably 0.05 μm or more and 40 μm or less, more preferably in the range of 0.4 to 20 μm. The undercoat layer may contain semiconductive particles, an electron transporting substance, or an electron accepting substance.

Photosensitive Layer

An electrophotographic photosensitive member according to an embodiment of the present invention includes a photosensitive layer (a charge generating layer and a charge transporting layer) on the support, the electroconductive layer, or the undercoat layer.

Examples of the charge generating substance for use in an electrophotographic photosensitive member according to an embodiment of the present invention include, but are not limited to, pyrylium, thiapyrylium dyes, phthalocyanine compounds, anthanthrone pigments, dibenzpyrenequinone pigments, pyranthrone pigments, azo pigments, indigo pigments, quinacridone pigments, and quinocyanine pigments. The charge generating substance may be gallium phthalocyanine. Hydroxy gallium phthalocyanine crystals having strong peaks at Bragg angles 2θ of 7.4°±0.3° and 28.2°±0.3° in CuKα characteristic X-ray diffraction have high sensitivity.

The charge generating layer may be formed by applying a charge generating layer coating solution and drying the coating solution. The charge generating layer coating solution is prepared by dispersing a charge generating substance together with a binder resin and a solvent. The charge generating layer may also be an evaporated film of a charge generating substance.

Examples of the binder resin for use in a charge generating layer of a multilayer photosensitive layer according to an embodiment of the present invention include, but are not limited to, polycarbonate resin, polyester resin, butyral resin, poly(vinyl acetal) resin, acrylic resin, vinyl acetate resin, and urea resin. The binder resin may be a butyral resin. These may be used alone or in combination as a mixture or a copolymer.

In the charge generating layer, the ratio of the binder resin to the charge generating substance may be 0.3 or more and 4 or less based on mass. The dispersion may be performed with a homogenizer, ultrasonic waves, a ball mill, a sand mill, an attritor, or a rolling mill.

Examples of the solvent for use in the charge generating layer coating solution include, but are not limited to, alcohol solvents, sulfoxide solvents, ketone solvents, ether solvents, ester solvents, and aromatic hydrocarbon solvents. The thickness of the charge generating layer is preferably 0.01 μm or more and 5 μm or less, more preferably 0.1 μm or more and 1 μm or less. The charge generating layer may contain an intensifier, an antioxidant, an ultraviolet absorber, and/or a plasticizer, if necessary.

In an electrophotographic photosensitive member having a multilayer photosensitive layer, a charge transporting layer is formed on a charge generating layer. In the case that the charge transporting layer is the surface layer as illustrated in FIG. 1A, the charge transporting layer can be formed by forming a coat by the use of a charge transporting layer coating liquid that contains a compound represented by the formula (1) dissolved in a solvent and polymerizing (chain-polymerizing) the compound represented by the formula (1) contained in the coat. In the case that the protective layer is the surface layer as illustrated in FIG. 1B, the charge transporting layer can be formed by forming a coat by the use of a charge transporting layer coating solution that contains a charge transporting substance and a binder resin dissolved in a solvent and drying the coat.

In the case that the protective layer is the surface layer as illustrated in FIG. 1B, examples of the charge transporting substance for use in the charge transporting layer include, but are not limited to, triarylamine compounds, hydrazone compounds, stilbene compounds, pyrazoline compounds, oxazole compounds, thiazole compounds, and triallylmethane compounds.

In the case that the protective layer is the surface layer as illustrated in FIG. 1B, examples of the binder resin for use in the charge transporting layer include, but are not limited to, poly(vinyl butyral) resin, polyarylate resin, polycarbonate resin, polyester resin, phenoxy resin, poly(vinyl acetate) resin, acrylic resin, polyacrylamide resin, polyamide resin, polyvinylpyridine, cellulose resin, urethane resin, epoxy resin, agarose resin, casein, poly(vinyl alcohol) resin, and polyvinylpyrrolidone.

In the case that the protective layer is the surface layer as illustrated in FIG. 1B, the charge transporting substance can constitute 30% by mass or more and 70% by mass or less of the total mass of the charge transporting layer.

In the case that the protective layer is the surface layer as illustrated in FIG. 1B, the solvent for use in the charge transporting layer coating solution include, but are not limited to, ether solvents, alcohol solvents, ketone solvents, and aromatic hydrocarbon solvents. The thickness of the charge transporting layer may be 5 μm or more and 40 μm or less.

In accordance with an embodiment of the present invention, a protective layer may be formed on the charge transporting layer. The protective layer can be formed by forming a coat by the use of a protective layer coating solution that contains a compound represented by the formula (1) dissolved in a solvent and polymerizing (chain-polymerizing) the compound represented by the formula (1) contained in the coat.

In the case that the protective layer contains a compound having a methacryloyloxy group other than a compound represented by the formula (1), the compound represented by the formula (1) can constitute 50% by mass or more and less than 100% by mass of the total solids of the protective layer coating solution.

The thickness of the protective layer may be 2 μm or more and 20 μm or less.

These coating solution may be applied by dip coating (dipping), spray coating, spinner coating, bead coating, blade coating, or beam coating.

A polymerization reaction in the formation of the surface layer will be described below. A compound having a chain-polymerizable functional group (a methacryloyloxy group) may be polymerized utilizing heat, light (such as ultraviolet rays), or radioactive rays (such as an electron ray). The compound may be polymerized utilizing radioactive rays, such as an electron ray.

Polymerization utilizing an electron ray can produce a three-dimensional network structure having a very high density and achieve excellent electric potential stability. Because of short and efficient polymerization, polymerization utilizing an electron ray has high productivity. An accelerator of an electron ray may be of a scanning type, an electrocurtain type, a broad beam type, a pulse type, or a laminar type.

The following are the conditions for electron ray irradiation. When the accelerating voltage of an electron ray is 120 kV or less, the electron ray does not cause a significant deterioration of material properties while the polymerization efficiency is maintained. The electron ray absorbed dose to the surface of an electrophotographic photosensitive member is preferably 5 kGy or more and 50 kGy or less, more preferably 1 kGy or more and 10 kGy or less.

In order to prevent oxygen from inhibiting electron ray polymerization of a compound having a chain-polymerizable functional group, electron ray irradiation in an inert gas atmosphere can be followed by heating in an inert gas atmosphere. Examples of the inert gas include, but are not limited to, nitrogen, argon, and helium.

Figure 2:
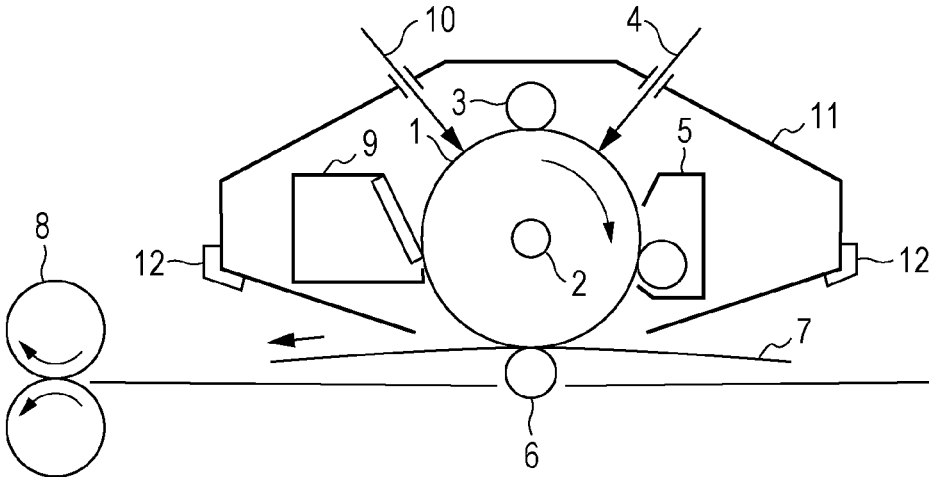
FIG. 2 is a schematic view of an electrophotographic apparatus that includes a process cartridge including an electrophotographic photosensitive member according to an embodiment of the present invention.

FIG. 2 is a schematic view of an electrophotographic apparatus that includes a process cartridge including an electrophotographic photosensitive member according to an embodiment of the present invention.

In FIG. 2, a drum-type electrophotographic photosensitive member 1 according to an embodiment of the present invention is rotated around a shaft 2 in the direction of the arrow at a predetermined peripheral speed (process speed). During the rotation, the surface of the electrophotographic photosensitive member 1 is uniformly positively or negatively charged at a predetermined potential by a charging device (primary charging device) 3. The electrophotographic photosensitive member 1 is then irradiated with intensity-modulated exposure light 4 emitted from an exposure device (not shown), such as a slit exposure device or a laser beam scanning exposure device, in response to the time-series electric digital image signals of intended image information. In this way, electrostatic latent images corresponding to the intended image information are successively formed on the surface of the electrophotographic photosensitive member 1.

The electrostatic latent images are then subjected to normal or reversal development with a toner in a developing device 5 to be made visible as toner images. The toner images on the electrophotographic photosensitive member 1 are successively transferred to a transferring member 7 by a transferring device 6. The transferring member 7 taken from a paper feeder (not shown) in synchronism with the rotation of the electrophotographic photosensitive member 1 is fed between the electrophotographic photosensitive member 1 and the transferring device 6. A bias voltage having polarity opposite to the polarity of the electric charges of the toner is applied to the transferring device 6 with a bias power supply (not shown). The transferring device may be an intermediate transfer device that includes a primary transfer member, an intermediate transfer member, and a secondary transfer member.

The transferring member 7 is then separated from the electrophotographic photosensitive member and is transported to a fixing device 8. After the toner images are fixed, the transferring member 7 is output from the electrophotographic apparatus as an image-formed article (such as a print or a copy).

Deposits, such as residual toner, on the surface of the electrophotographic photosensitive member 1 after the toner images have been transferred are removed with a cleaning device 9. The residual toner may be recovered with the developing device 5. If necessary, the electrophotographic photosensitive member 1 is again used in image forming after the electricity is removed with pre-exposure light 10 from a pre-exposure device (not shown). In the case that the charging device 3 is a contact charging device, such as a charging roller, pre-exposure is not necessarily required.

A plurality of components selected from the electrophotographic photosensitive member 1, the charging device 3, the developing device 5, the transferring device 6, and the cleaning device 9 may be housed in a container to provide a process cartridge. The process cartridge may be detachably attached to the main body of an electrophotographic apparatus, such as a copying machine or a laser-beam printer. For example, at least one device selected from the group consisting of the charging device 3, the developing device 5, the transferring device 6, and the cleaning device 9 may be integrally supported together with the electrophotographic photosensitive member 1 to provide a process cartridge 11, which is detachably attachable to the main body of an electrophotographic apparatus through a guide unit 12, such as rails.

EXAMPLES

The present invention will be further described in the following examples and comparative examples. The term "part" in the examples means "part by mass".

Example 1

An aluminum cylinder having a diameter of 30 mm, a length of 357.5 mm, and a thickness of 1 mm was used as a support (electroconductive support).

50 parts of titanium oxide particles covered with tin oxide containing 10% antimony oxide (trade name: ECT-62, manufactured by Titan Kogyo, Ltd.), 25 parts of a resole phenolic resin (trade name: Phenolite J-325, manufactured by Dainippon Ink and Chemicals, Inc., solid content 70% by mass), 20 parts of methyl cellosolve, 5 parts of methanol, and 0.002 parts of a silicone oil (a polydimethylsiloxane-polyoxyalkylene copolymer having an average molecular weight of 3000) were dispersed for two hours with a sand mill using glass beads having a diameter of 0.8 mm to prepare an electroconductive-layer coating solution.

The electroconductive-layer coating solution was applied to the support by dip coating and was dried at 140° C. for 30 minutes to form an electroconductive layer having a thickness of 15 μm.

2.5 parts of a nylon 6-66-610-12 quaterpolymer resin (trade name: CM8000, manufactured by Toray Industries, Inc.) and 7.5 parts of an N-methoxymethylated 6 nylon resin (trade name: Toresin EF-30T, manufactured by Nagase ChemteX Corp.) were dissolved in a mixed solvent of 100 parts of methanol and 90 parts of butanol to prepare an undercoat layer coating solution.

The undercoat layer coating solution was applied to the electroconductive layer by dip coating and was dried at 100° C. for 10 minutes to form an undercoat layer having a thickness of 0.7 μm.

11 parts of hydroxy gallium phthalocyanine crystals (a charge generating substance) were prepared. The crystals had strong peaks at Bragg angles (2θ±0.2°) of 7.4° and 28.2° in CuKα characteristic X-ray diffraction. A mixture of 5 parts of a poly(vinyl butyral) resin (trade name: S-LecBX-1, manufactured by Sekisui Chemical Co., Ltd.) and 130 parts of cyclohexanone was dispersed with 500 parts of glass beads having a diameter of 1 mm at 1800 rpm for two hours while the mixture was cooled with cooling water at 18° C. After dispersion, the mixture was diluted with 300 parts of ethyl acetate and 160 parts of cyclohexanone to prepare a charge generating layer coating solution.

The average particle size (median) of the hydroxy gallium phthalocyanine crystals in the charge generating layer coating solution was 0.18 μm as measured with a centrifugal particle size analyzer (trade name: CAPA-700) manufactured by Horiba, Ltd., the principle of which is based on liquid phase sedimentation.

The charge generating layer coating solution was applied to the undercoat layer by dip coating and was dried at 110° C. for 10 minutes to form a charge generating layer having a thickness of 0.17 μm.

5 parts of a compound represented by the following formula (2) (a charge transporting substance), 5 parts of a compound represented by the following formula (3) (a charge transporting substance), and 10 parts of a polycarbonate resin (trade name: Iupilon Z400, manufactured by Mitsubishi Gas Chemical Co., Inc.) were dissolved in a mixed solvent of 70 parts of monochlorobenzene and 30 parts of dimethoxymethane to prepare a charge transporting layer coating solution.

The charge transporting layer coating solution was applied to the charge generating layer by dip coating and was dried at 100° C. for 30 minutes to form a charge transporting layer having a thickness of 18 μm.

(2)

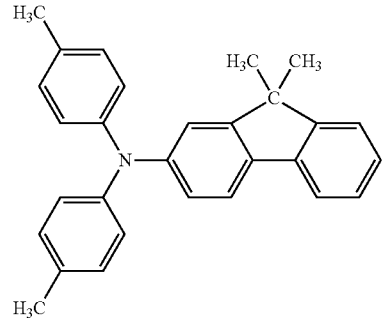

(3)

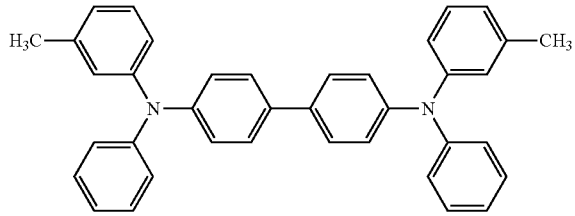

100 parts of an exemplary compound (1-3), which is a compound represented by the formula (1), was dissolved in 100 parts of n-propanol. 100 parts of 1,1,2,2,3,3,4-heptafluorocyclopentane (trade name: Zeorora H, manufactured by Zeon Corp.) was added to the solution to prepare a protective layer coating solution.

The protective layer coating solution was applied to the charge transporting layer by dip coating, and the resulting coat was heat-treated at 50° C. for five minutes. The coat was then irradiated with an electron ray for 1.6 seconds in a nitrogen atmosphere at an accelerating voltage of 70 kV and an absorbed dose of 50000 Gy. The coat was then heat-treated at 130° C. for 30 seconds in a nitrogen atmosphere. The processes from the electron ray irradiation to the 30-second heat treatment were performed at an oxygen concentration of 19 ppm. The coat was then heat-treated at 110° C. for 20 minutes in the atmosphere to form a protective layer having a thickness of 5 μm.

In this manner, an electrophotographic photosensitive member was produced. The electrophotographic photosensitive member included the support, the electroconductive layer, the undercoat layer, the charge generating layer, the charge transporting layer, and the protective layer. The protective layer was the surface layer.

Examples 1 to 10

An electrophotographic photosensitive member was produced in the same manner as in Example 1 except that the protective layer coating solution was prepared using an exemplary compound listed in Table 1 instead of the compound represented by the formula (1).

Example 11

An electrophotographic photosensitive member was produced in the same manner as in Example 1 except that the protective layer coating solution was prepared using 80 parts of the exemplary compound (1-3) and 20 parts of trimethylolpropane triacrylate (product name: Miramer M300, manufactured by Toyo Chemicals Co., Ltd.) instead of 100 parts of the exemplary compound (1-3).

Examples 12 and 13

An electrophotographic photosensitive member was produced in the same manner as in Example 11 except that the protective layer coating solution was prepared using an exemplary compound listed in Table 1 instead of the compound represented by the formula (1).

Example 14

An electrophotographic photosensitive member was produced in the same manner as in Example 11 except that the protective layer coating solution was prepared using trimethylolpropane trimethacrylate (product name: Miramer M301, manufactured by Toyo Chemicals Co., Ltd.) instead of trimethylolpropane triacrylate.

Examples 15 and 16

An electrophotographic photosensitive member was produced in the same manner as in Example 14 except that the protective layer coating solution was prepared using an exemplary compound listed in Table 1 instead of the compound represented by the formula (1).

Example 17

An electrophotographic photosensitive member was produced in the same manner as in Example 11 except that the protective layer coating solution was prepared using a compound represented by the following formula (A-1) instead of trimethylolpropane triacrylate.

(A-1)

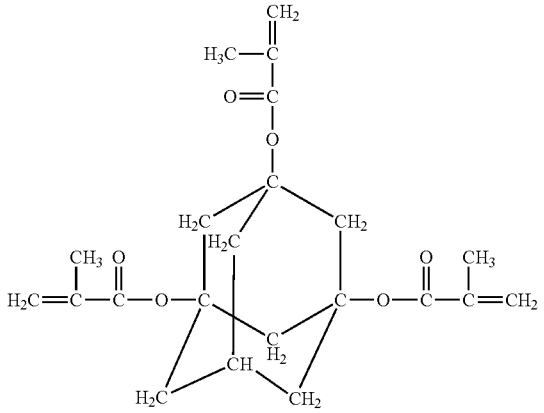

Examples 18 and 19

An electrophotographic photosensitive member was produced in the same manner as in Example 17 except that the protective layer coating solution was prepared using an exemplary compound listed in Table 1 instead of the compound represented by the formula (1).

Example 20

An electrophotographic photosensitive member was produced in the same manner as in Example 11 except that the protective layer coating solution was prepared using a compound represented by the following formula (A-2) instead of trimethylolpropane triacrylate.

(A-2)

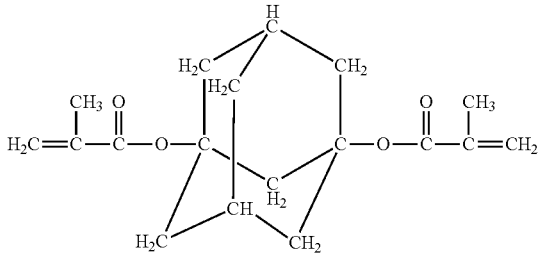

Example 21

An electrophotographic photosensitive member was produced in the same manner as in Example 20 except that the protective layer coating solution was prepared by changing the amount of exemplary compound (1-3) from 80 parts to 60 parts and changing the amount of compound represented by the formula (A-2) from 20 parts to 40 parts.

Example 22

An electrophotographic photosensitive member was produced in the same manner as in Example 20 except that the protective layer coating solution was prepared by changing the amount of exemplary compound (1-3) from 80 parts to 40 parts and changing the amount of compound represented by the formula (A-2) from 20 parts to 60 parts.

Examples 23 and 24

An electrophotographic photosensitive member was produced in the same manner as in Example 20 except that the protective layer coating solution was prepared using an exemplary compound listed in Table 1 instead of the compound represented by the formula (1).

Example 25

An electrophotographic photosensitive member was produced in the same manner as in Example 11 except that the protective layer coating solution was prepared using a compound represented by the following formula (B-1) instead of trimethylolpropane triacrylate.

(B-1)

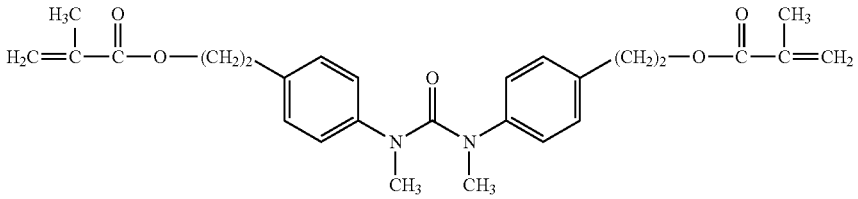

Examples 26 and 27

An electrophotographic photosensitive member was produced in the same manner as in Example 25 except that the protective layer coating solution was prepared using an exemplary compound listed in Table 1 instead of the compound represented by the formula (1).

Example 28

An electrophotographic photosensitive member was produced in the same manner as in Example 11 except that the protective layer coating solution was prepared using a compound represented by the following formula (C-1) instead of trimethylolpropane triacrylate.

(C-1)

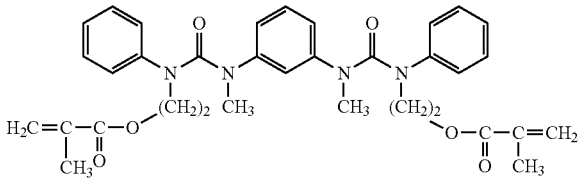

Examples 29 and 30

An electrophotographic photosensitive member was produced in the same manner as in Example 28 except that the protective layer coating solution was prepared using an exemplary compound listed in Table 1 instead of the compound represented by the formula (1).

Example 31

An electrophotographic photosensitive member was produced in the same manner as in Example 1 except that the protective layer coating solution was prepared using 95 parts of the exemplary compound (1-3) and 5 parts of a compound represented by the following formula (D-1) instead of 100 parts of the exemplary compound (1-3).

(D-1)

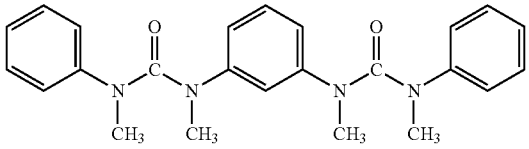

Examples 32 and 33

An electrophotographic photosensitive member was produced in the same manner as in Example 31 except that the protective layer coating solution was prepared using an exemplary compound listed in Table 1 instead of the compound represented by the formula (1).

Example 34

An electrophotographic photosensitive member was produced in the same manner as in Example 1 except the following: the protective layer coating solution was prepared by dissolving 99 parts of the exemplary compound (1-3) and 1 part of 1-hydroxy-cyclohexyl-phenyl-ketone (trade name: Irgacure 184, manufactured by Ciba Specialty Chemicals Co., Ltd.) in 100 parts of n-propanol and adding 100 parts of 1,1,2,2,3,3,4-heptafluorocyclopentane (trade name: Zeorora H, manufactured by Zeon Corp.) to the solution; and the protective layer coating solution was applied to the charge transporting layer by dip coating, and the resulting coat was heat-treated at 50° C. for five minutes, was irradiated with light from a metal halide lamp at an irradiation intensity of 500 mW/cm$^2$ for 20 seconds, and was heat-treated at 130° C. for 30 minutes to form a protective layer having a thickness of 5 μm.

Example 35

An electrophotographic photosensitive member was produced in the same manner as in Example 1 except that the protective layer was formed by electron ray irradiation in a nitrogen atmosphere at an accelerating voltage of 50 kV and an absorbed dose of 5000 Gy for 1.6 seconds.

Example 36

The charge transporting layer coating liquid in Example 1 was replaced by a charge transporting layer coating solution that was prepared by dissolving 100 parts of the exemplary compound (1-3) in 100 parts of n-propanol and adding 100 parts of 1,1,2,2,3,3,4-heptafluorocyclopentane (trade name: Zeorora H, manufactured by Zeon Corp.) to the solution. No protective layer was formed. The charge transporting layer coating solution was applied to the charge generating layer by dip coating, and the resulting coat was heat-treated at 50° C. for five minutes. The coat was then irradiated with an electron ray for 1.6 seconds in a nitrogen atmosphere at an accelerating voltage of 70 kV and an absorbed dose of 50000 Gy. The coat was then heat-treated at 130° C. for 30 seconds in a nitrogen atmosphere. The processes from the electron ray irradiation to the 30-second heat treatment were performed at an oxygen concentration of 19 ppm. The coat was then heat-treated at 110° C. for 20 minutes in the atmosphere to form a charge transporting layer having a thickness of 10 μm.

Example 37

An electrophotographic photosensitive member was produced in the same manner as in Example 1 except that the protective layer coating solution was prepared using 0.005 parts of hydroquinone monomethyl ether (manufactured by Tokyo Chemical Industry Co., Ltd.).

Examples 38 and 39

An electrophotographic photosensitive member was produced in the same manner as in Example 37 except that the protective layer coating solution was prepared using an exemplary compound listed in Table 1 instead of the compound represented by the formula (1).

Example 40

An electrophotographic photosensitive member was produced in the same manner as in Example 1 except that the protective layer coating solution was prepared using 0.15 parts of hydroquinone monomethyl ether (manufactured by Tokyo Chemical Industry Co., Ltd.).

COMPARATIVE EXAMPLES

The following compounds (R-1) to (R-16) are comparative compounds for the compound represented by the formula (1).

(R-1)

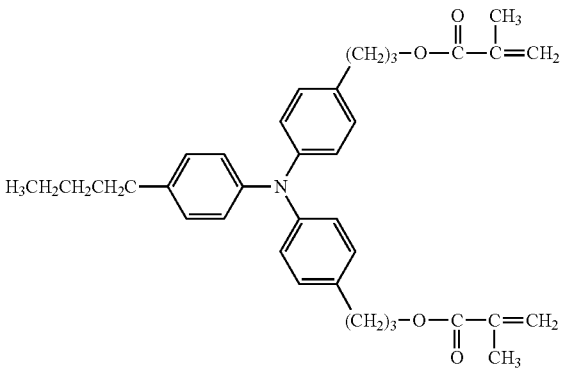

-continued (R-2)

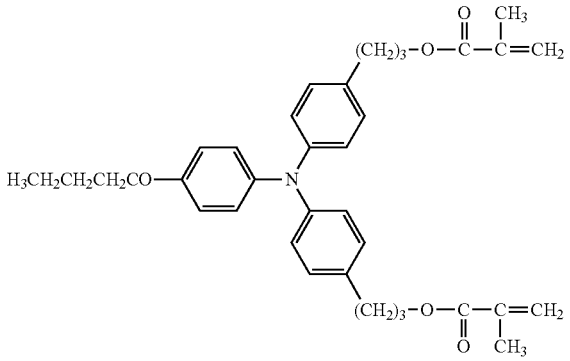

(R-3)

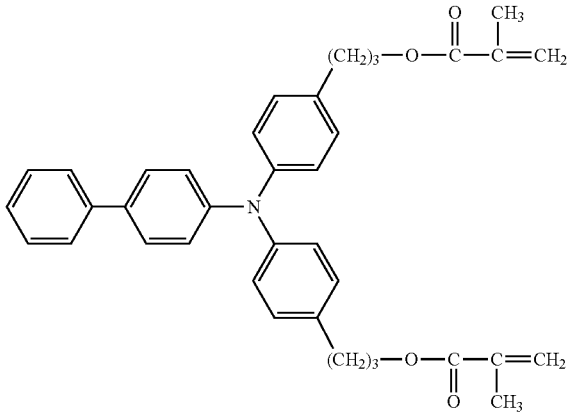

(R-4)

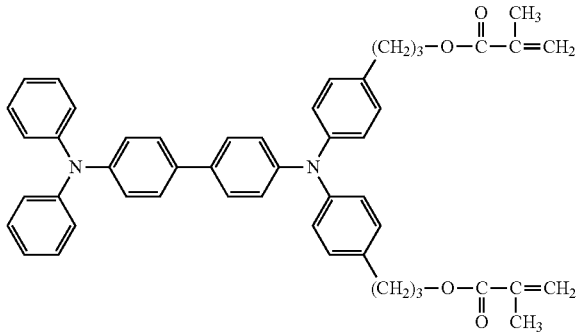

(R-5)

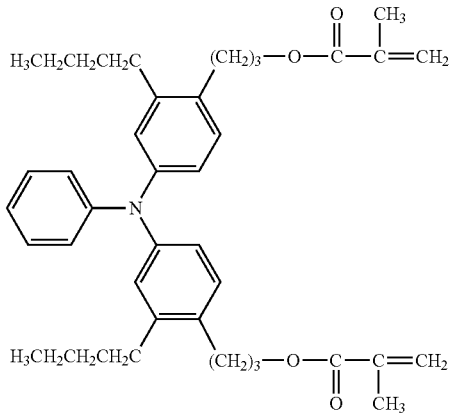

-continued
(R-6)
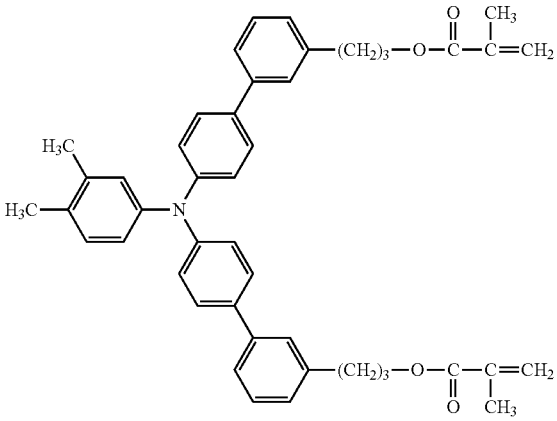
(R-7)
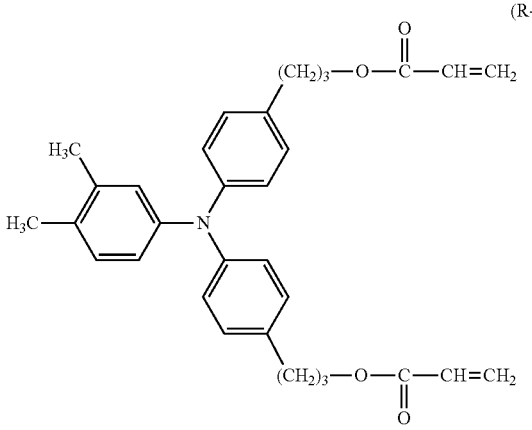
(R-8)
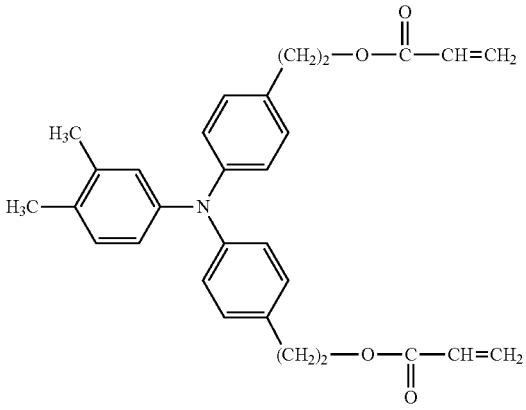
-continued
(R-9)
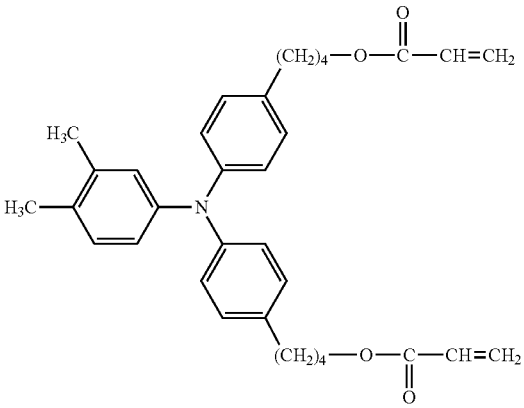
(R-10)
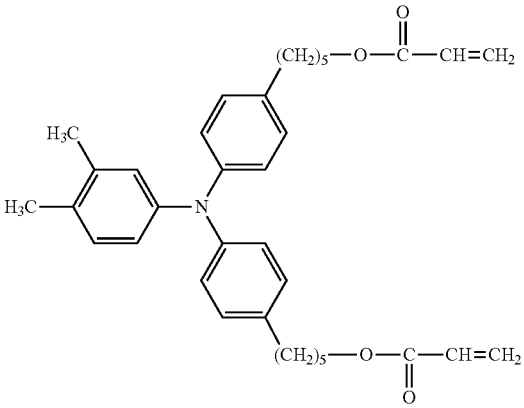
(R-11)
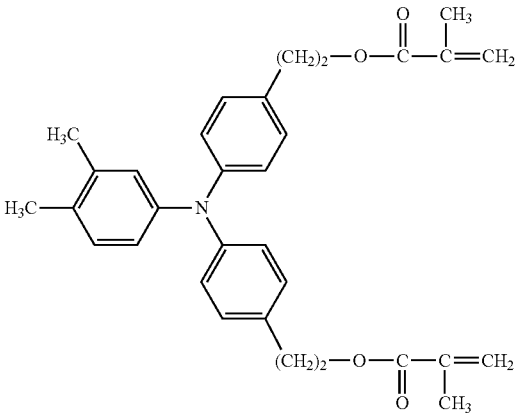

-continued (R-12)

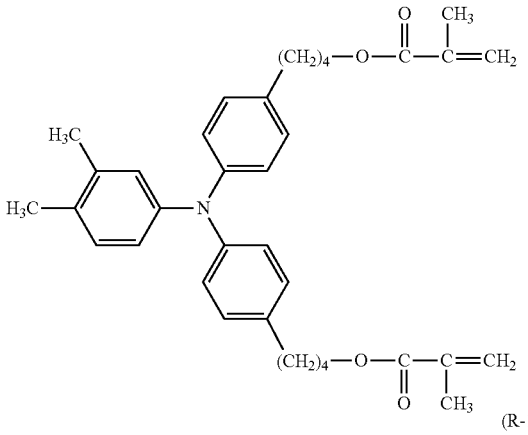

(R-13)

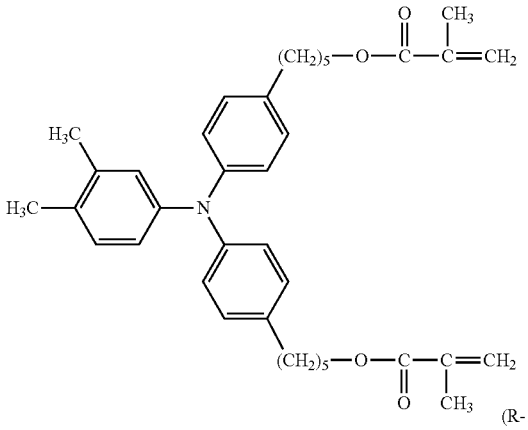

(R-14)

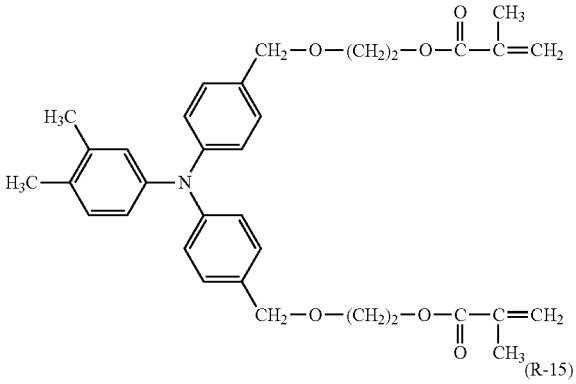

(R-15)

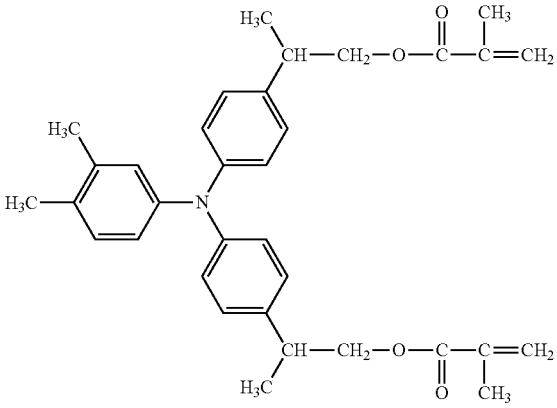

-continued (R-16)

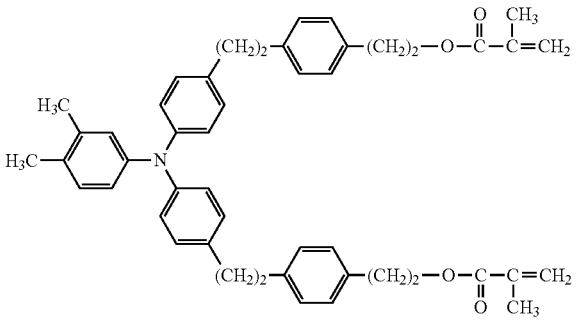

Comparative Examples 1 to 13

An electrophotographic photosensitive member was produced in the same manner as in Example 1 except that the protective layer coating solution was prepared using a comparative compound listed in Table 1 instead of the compound represented by the formula (1) and without using hydroquinone monomethyl ether.

Comparative Examples 14 and 15

An electrophotographic photosensitive member was produced in the same manner as in Example 13 except that the protective layer coating solution was prepared using a comparative compound listed in Table 1 instead of the compound represented by the formula (1) and without using hydroquinone monomethyl ether.

Comparative Examples 16 and 17

An electrophotographic photosensitive member was produced in the same manner as in Example 17 except that the protective layer coating solution was prepared using a comparative compound listed in Table 1 instead of the compound represented by the formula (1) and without using hydroquinone monomethyl ether.

Comparative Examples 18 and 19

An electrophotographic photosensitive member was produced in the same manner as in Example 21 except that the protective layer coating solution was prepared using a comparative compound listed in Table 1 instead of the compound represented by the formula (1) and without using hydroquinone monomethyl ether.

Comparative Examples 20 and 21

An electrophotographic photosensitive member was produced in the same manner as in Example 25 except that the protective layer coating solution was prepared using a comparative compound listed in Table 1 instead of the compound represented by the formula (1) and without using hydroquinone monomethyl ether.

Comparative Examples 22 to 24

An electrophotographic photosensitive member was produced in the same manner as in Example 1 except that the protective layer coating solution was prepared using a comparative compound listed in Table 1 instead of the compound represented by the formula (1) and without using hydroquinone monomethyl ether.

Comparative Examples 25 and 26

An electrophotographic photosensitive member was produced in the same manner as in Example 36 except that the charge transporting layer coating solution was prepared using a comparative compound listed in Table 1 instead of the compound represented by the formula (1) and without using hydroquinone monomethyl ether.

TABLE 1

| Example | Exemplary compound | Comparative example | Exemplary compound |
|---|---|---|---|
| Example 1 | 1-3 | Comparative example 1 | R-1 |
| Example 2 | 1-1 | Comparative example 2 | R-2 |
| Example 3 | 1-2 | Comparative example 3 | R-3 |
| Example 4 | 1-6 | Comparative example 4 | R-4 |
| Example 5 | 1-7 | Comparative example 5 | R-5 |
| Example 6 | 1-9 | Comparative example 6 | R-6 |
| Example 7 | 1-10 | Comparative example 7 | R-7 |
| Example 8 | 1-12 | Comparative example 8 | R-8 |
| Example 9 | 1-4 | Comparative example 9 | R-9 |
| Example 10 | 1-13 | Comparative example 10 | R-10 |
| Example 11 | 1-3 | Comparative example 11 | R-11 |
| Example 12 | 1-1 | Comparative example 12 | R-12 |
| Example 13 | 1-2 | Comparative example 13 | R-13 |
| Example 14 | 1-3 | Comparative example 14 | R-11 |
| Example 15 | 1-1 | Comparative example 15 | R-12 |
| Example 16 | 1-2 | Comparative example 16 | R-11 |
| Example 17 | 1-3 | Comparative example 17 | R-12 |
| Example 18 | 1-1 | Comparative example 18 | R-11 |
| Example 19 | 1-2 | Comparative example 19 | R-12 |
| Example 20 | 1-3 | Comparative example 20 | R-11 |
| Example 21 | 1-3 | Comparative example 21 | R-12 |
| Example 22 | 1-3 | Comparative example 22 | R-14 |
| Example 23 | 1-1 | Comparative example 23 | R-15 |
| Example 24 | 1-2 | Comparative example 24 | R-16 |
| Example 25 | 1-3 | Comparative example 25 | R-11 |
| Example 26 | 1-1 | Comparative example 26 | R-12 |
| Example 27 | 1-2 | | |
| Example 28 | 1-3 | | |
| Example 29 | 1-1 | | |
| Example 30 | 1-2 | | |
| Example 31 | 1-3 | | |
| Example 32 | 1-1 | | |
| Example 33 | 1-2 | | |
| Example 34 | 1-3 | | |
| Example 35 | 1-3 | | |
| Example 36 | 1-3 | | |
| Example 37 | 1-3 | | |
| Example 38 | 1-1 | | |
| Example 39 | 1-2 | | |
| Example 40 | 1-3 | | |

Evaluation of Electrophotographic Photosensitive Member

The electrophotographic photosensitive members according to Examples 1 to 40 and Comparative Examples 1 to 26 were evaluated in the following manner.

The percentage of the residual chain-polymerizable functional group was determined in the following manner.

A portion of a surface layer 179 mm away from one end of an electrophotographic photosensitive member was removed with a razor. The portion of the surface layer was subjected to a Fourier transform infrared attenuated total reflection spectroscopic study to determine the IR peak ratio of the residual chain-polymerizable functional group (a methacryloyloxy group or an acryloyloxy group) that was not involved in the polymerization reaction. A Fourier transform infrared spectrophotometer Spectrum One FT-IR Spectrometer manufactured by Perkin Elmer Instruments was used with a Ge prism and a KRS-5 prism. The peak area assigned to the in-plane bending vibration of a terminal olefin ($CH_2$=) of the methacryloyloxy group was determined at wave numbers of 1394 $cm^{-1}$ or more and 1413 $cm^{-1}$ or less. The peak area assigned to the stretching vibration of carbonyl (C=O) of the methacryloyloxy group was determined at wave numbers of 1689 $cm^{-1}$ or more and 1759 $cm^{-1}$ or less. The ratio of the peak area of the olefin to the peak area of carbonyl was calculated as the IR peak ratio of the residual methacryloyloxy group. The peak area assigned to the in-plane bending vibration of a terminal olefin ($CH_2$=) of the acryloyloxy group was determined at wave numbers of 1400 $cm^{-1}$ or more and 1413 $cm^{-1}$ or less. The peak area assigned to the stretching vibration of carbonyl (C=O) of the acryloyloxy group was determined at wave numbers of 1699 $cm^{-1}$ or more and 1769 $cm^{-1}$ or less. The ratio of the peak area of the olefin to the peak area of carbonyl was calculated as the IR peak ratio of the residual acryloyloxy group. Table 2 shows the results.

Electric potential stability (variation in light area potential) was evaluated in the following manner.

An electrophotographic copying machine GP-405 (manufactured by CANON KABUSHIKI KAISHA) was used after modified such that a corona charger could be connected to an external power supply. The GP-405 was further modified such that the corona charger could be attached to a drum cartridge. A charger for an electrophotographic copying machine GP-55 (manufactured by CANON KABUSHIKI KAISHA) was used as the corona charger. The electrophotographic photosensitive member was attached to the drum cartridge, which was attached to the modified GP-405. The variation in light area potential was evaluated as described below. A heater (drum heater (cassette heater)) for the electrophotographic photosensitive member was in the OFF position during the evaluation.

The surface potential of the electrophotographic photosensitive member was measured by removing a developing unit from the main body of the electrophotographic copying machine and fixing a potential measuring probe (model 6000B-8, manufactured by Trek Japan) at a position of development. A transferring unit was not in contact with the electrophotographic photosensitive member, and a paper sheet was not fed while measuring the surface potential.

The charger was connected to an external power supply. The power supply was controlled with a high-voltage supply controller (Model 610C, manufactured by Trek Inc.) such that the electric current flowing through a corona wire was 500 μA. The constant-current control scorotron grid applied voltage and light exposure conditions were controlled such that the electrophotographic photosensitive member had an initial dark area potential (Vd) of approximately −650 (V) and an initial light area potential (Vl) of approximately −200 (V).

The electrophotographic photosensitive member was installed in the copying machine. An image having an image ratio of 5% was printed on 1000 pieces of A4-size portrait paper at a temperature of 30° C. and a humidity of 80% RH. After that, the light area potential (Vl) was measured, and the potential variation ΔVl relative to the initial light area potential was calculated. Table 2 shows the results.

Image deletion after the repeated use of an electrophotographic photosensitive member was evaluated in the following manner.

After the evaluation of variation in light area potential, the electrophotographic photosensitive member was again installed in the copying machine. After an image having an image ratio of 5% was printed on 9000 pieces of A4-size portrait paper (10,000 in total), the supply of electricity to the copying machine was stopped, and the copying machine was suspended for 24 hours. After 24 hours, electricity was again supplied to the copying machine. A lattice image (4 lines, 40 spaces) and a character image (E character image) consisting of letter E's of the alphabet (font: Times, font size 6-point) were printed on A4-size portrait paper.

Likewise, after printing of an additional 10,000 (20,000 in total) and 30,000 (50,000 in total) pieces of paper, the supply of electricity to the copying machine was stopped, and the copying machine was suspended for 24 hours. In each case, electricity was again supplied to the copying machine after 24 hours, and the lattice image and the E character image were printed on A4-size portrait paper.

The printed images were evaluated for the image deletion preventing effect in accordance with the following criteria. Levels 5, 4, and 3 indicate a satisfactory image deletion preventing effect, and level 5 is excellent.

Levels 1 and 2 indicate little or no image deletion preventing effect. Table 2 shows the results.

Level 5: Both the lattice image and the E character image have no image defect.

Level 4: The lattice image is partly blurred, but the E character image has no image defect.

Level 3: The lattice image is partly blurred, and the E character image is partly thin.

Level 2: The lattice image is partly lost, and the E character image is thin over the entire surface.

Level 1: The lattice image is lost over the entire surface, and the E character image is thin over the entire surface.

TABLE 2

| | Percentage of residual chain-polymerizable functional group | | Variation in light area | Evaluation of image deletion | | |
|---|---|---|---|---|---|---|
| | Ge prism | KRS-5 prism | potential (V) | After printing on 10000 pieces of paper | After printing on 20000 pieces of paper | After printing on 50000 pieces of paper |
| Example 1 | 0.004 | 0.005 | 20 | 4 | 4 | 4 |
| Example 2 | 0.004 | 0.005 | 20 | 4 | 4 | 4 |
| Example 3 | 0.004 | 0.005 | 20 | 4 | 4 | 4 |

TABLE 2-continued

| | Percentage of residual chain-polymerizable functional group | | Variation in light area | Evaluation of image deletion | | |
|---|---|---|---|---|---|---|
| | Ge prism | KRS-5 prism | potential (V) | After printing on 10000 pieces of paper | After printing on 20000 pieces of paper | After printing on 50000 pieces of paper |
| Example 4 | 0.004 | 0.006 | 30 | 4 | 4 | 4 |
| Example 5 | 0.004 | 0.005 | 25 | 4 | 4 | 4 |
| Example 6 | 0.004 | 0.006 | 30 | 4 | 4 | 4 |
| Example 7 | 0.004 | 0.005 | 30 | 4 | 4 | 3 |
| Example 8 | 0.004 | 0.005 | 30 | 4 | 4 | 3 |
| Example 9 | 0.004 | 0.006 | 30 | 4 | 4 | 4 |
| Example 10 | 0.004 | 0.006 | 30 | 4 | 4 | 4 |
| Example 11 | 0.008 | 0.01 | 30 | 4 | 4 | 3 |
| Example 12 | 0.008 | 0.01 | 30 | 4 | 4 | 3 |
| Example 13 | 0.008 | 0.01 | 30 | 4 | 4 | 3 |
| Example 14 | 0.004 | 0.005 | 25 | 5 | 4 | 4 |
| Example 15 | 0.004 | 0.005 | 25 | 5 | 4 | 4 |
| Example 16 | 0.004 | 0.005 | 25 | 5 | 4 | 4 |
| Example 17 | 0.003 | 0.003 | 20 | 5 | 5 | 4 |
| Example 18 | 0.003 | 0.003 | 20 | 5 | 5 | 4 |
| Example 19 | 0.003 | 0.003 | 20 | 5 | 5 | 4 |
| Example 20 | 0.003 | 0.003 | 20 | 5 | 5 | 4 |
| Example 21 | 0.003 | 0.003 | 20 | 5 | 5 | 4 |
| Example 22 | 0.002 | 0.002 | 25 | 5 | 5 | 4 |
| Example 23 | 0.003 | 0.003 | 20 | 5 | 5 | 4 |
| Example 24 | 0.003 | 0.003 | 20 | 5 | 5 | 4 |
| Example 25 | 0.004 | 0.006 | 10 | 5 | 5 | 4 |
| Example 26 | 0.004 | 0.006 | 10 | 5 | 5 | 4 |
| Example 27 | 0.004 | 0.006 | 10 | 5 | 5 | 4 |
| Example 28 | 0.004 | 0.006 | 10 | 5 | 5 | 4 |
| Example 29 | 0.004 | 0.006 | 10 | 5 | 5 | 4 |
| Example 30 | 0.004 | 0.006 | 10 | 5 | 5 | 4 |
| Example 31 | 0.004 | 0.005 | 10 | 5 | 5 | 4 |
| Example 32 | 0.004 | 0.005 | 10 | 5 | 5 | 4 |
| Example 33 | 0.004 | 0.005 | 10 | 5 | 5 | 4 |
| Example 34 | 0.01 | 0.012 | 35 | 4 | 3 | 3 |
| Example 35 | 0.005 | 0.005 | 15 | 5 | 4 | 4 |
| Example 36 | 0.004 | 0.005 | 30 | 4 | 4 | 4 |
| Example 37 | 0.005 | 0.005 | 20 | 5 | 5 | 5 |
| Example 38 | 0.005 | 0.005 | 20 | 5 | 5 | 5 |
| Example 39 | 0.005 | 0.005 | 20 | 5 | 5 | 5 |
| Example 40 | 0.006 | 0.006 | 25 | 5 | 5 | 5 |

TABLE 3

| | Percentage of residual chain-polymerizable functional group | | Variation in light area | Evaluation of image deletion | | |
|---|---|---|---|---|---|---|
| | Ge prism | KRS-5 prism | potential (V) | After printing on 10000 pieces of paper | After printing on 20000 pieces of paper | After printing on 100000 pieces of paper |
| Comparative example 1 | 0.011 | 0.012 | 30 | 2 | 2 | 2 |
| Comparative example 2 | 0.011 | 0.012 | 30 | 2 | 2 | 2 |
| Comparative example 3 | 0.011 | 0.012 | 30 | 2 | 2 | 2 |
| Comparative example 4 | 0.011 | 0.012 | 30 | 2 | 2 | 2 |
| Comparative example 5 | 0.011 | 0.012 | 30 | 2 | 2 | 2 |
| Comparative example 6 | 0.011 | 0.012 | 30 | 2 | 2 | 2 |
| Comparative example 7 | 0.02 | 0.023 | 25 | 2 | 1 | 1 |
| Comparative example 8 | 0.028 | 0.03 | 30 | 2 | 1 | 1 |
| Comparative example 9 | 0.022 | 0.024 | 30 | 2 | 1 | 1 |
| Comparative example 10 | 0.024 | 0.026 | 40 | 2 | 1 | 1 |
| Comparative example 11 | 0.014 | 0.018 | 30 | 2 | 2 | 1 |
| Comparative example 12 | 0.005 | 0.006 | 30 | 3 | 1 | 1 |
| Comparative example 13 | 0.007 | 0.008 | 40 | 3 | 1 | 1 |
| Comparative example 14 | 0.014 | 0.018 | 35 | 2 | 2 | 1 |
| Comparative example 15 | 0.005 | 0.006 | 35 | 3 | 1 | 1 |
| Comparative example 16 | 0.011 | 0.015 | 30 | 2 | 2 | 2 |

TABLE 3-continued

| | Percentage of residual chain-polymerizable functional group | | Variation in light area | Evaluation of image deletion | | |
|---|---|---|---|---|---|---|
| | Ge prism | KRS-5 prism | potential (V) | After printing on 10000 pieces of paper | After printing on 20000 pieces of paper | After printing on 100000 pieces of paper |
| Comparative example 17 | 0.004 | 0.004 | 30 | 3 | 2 | 2 |
| Comparative example 18 | 0.014 | 0.02 | 15 | 2 | 2 | 1 |
| Comparative example 19 | 0.005 | 0.008 | 15 | 3 | 2 | 1 |
| Comparative example 20 | 0.014 | 0.018 | 15 | 3 | 2 | 1 |
| Comparative example 21 | 0.005 | 0.006 | 15 | 3 | 2 | 1 |
| Comparative example 22 | 0.009 | 0.01 | 55 | 2 | 1 | 1 |
| Comparative example 23 | 0.02 | 0.025 | 35 | 2 | 1 | 1 |
| Comparative example 24 | 0.018 | 0.02 | 40 | 3 | 1 | 1 |
| Comparative example 25 | 0.014 | 0.018 | 40 | 2 | 2 | 1 |
| Comparative example 26 | 0.005 | 0.006 | 40 | 3 | 1 | 1 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-115862 filed May 24, 2011, No. 2011-115863 filed May 24, 2011, No. 2011-262124 filed Nov. 30, 2011, and No. 2012-100966 filed Apr. 26, 2012, which are hereby incorporated by reference herein in their entirety.

What is claimed is:

1. An electrophotographic photosensitive member, comprising:

a support, a photosensitive layer formed on the support, wherein the electrophotographic photosensitive member comprises a surface layer comprising a polymer obtainable by the polymerization of a compound with one or more chain-polymerizable functional groups, wherein the compound with one or more chain-polymerizable functional groups is a compound represented by the following formula (1); and (1)

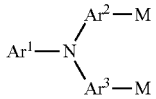

(M)

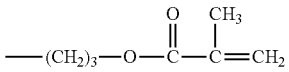

wherein, in the formula (1), $Ar^1$ represents an unsubstituted or substituted phenyl group, $Ar^2$ and $Ar^3$ each independently represents an unsubstituted or substituted phenylene group, M is a group represented by the above formula (M), a substituent group of the substituted phenyl group and a substituent group of the substituted phenylene group is each independently a methyl group, an ethyl group, n-propyl group, a methoxy group, an ethoxy group, a propoxy group, a fluorine atom, a chlorine atom, or a bromine atom.

2. An electrophotographic photosensitive member according to claim 1, wherein, in the formula (1), $Ar^1$ is a phenyl group or a phenyl group substituted with a methyl group.

3. An electrophotographic photosensitive member according to claim 1, wherein the polymer is obtainable by the polymerization of a composition comprising:

the compound represented by the formula (1), and a compound represented by the following formula (A); and (A)

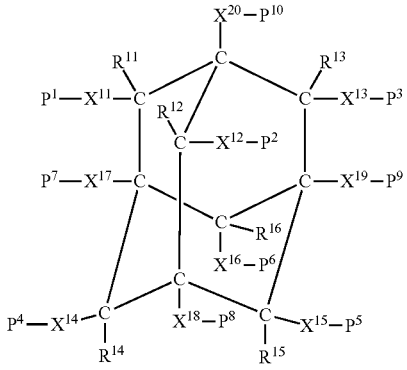

wherein, in the formula (A), $R^{11}$ to $R^{16}$ each independently represents a hydrogen atom, a methyl group, an ethyl group, a n-propyl group, a trifluoromethyl group, a hydroxy group, a methoxy group, an ethoxy group, an amino group, a dimethylamino group, a trimethylsilyl group, a fluorine atom, a chlorine atom, or a bromine atom, $X^{11}$ to $X^{20}$ each independently represents a single bond, or an alkylene group, $P^1$ to $P^{10}$ each independently represents a hydrogen atom, a methyl group, an ethyl group, a n-propyl group, a trifluoromethyl group, a hydroxy group, a methoxy group, an ethoxy group, an amino group, a dimethylamino group, a trimethylsilyl group, a fluorine atom, a chlorine atom, a bromine atom, or a methacryloyloxy group, at least one of the $P^1$ to $P^{10}$ is a methacryloyloxy group, however, where $X^{11}$ is a single bond, $P^1$ and $R^{11}$ may combine to form an oxo group (=O), where $X^{12}$ is a single bond, $P^2$ and $R^{12}$ may combine to form an oxo group (=O), where $X^{13}$ is a single bond, $P^3$ and $R^{13}$ may combine to form an oxo group (=O), where $X^{14}$ is a single bond, $P^4$ and $R^{14}$ may combine to form an oxo group (=O), where $X^{15}$ is a single bond, $P^5$ and $R^{15}$ may combine to form an oxo group (=O), and, where $X^{16}$ is a single bond, $P^6$ and $R^{16}$ may combine to form an oxo group (=O), and, $R^{11}$ is a hydrogen atom where $P^1$ is a methacryloyloxy group, $R^{12}$ is a hydrogen atom where $P^2$ is a methacryloyloxy group, $R^{13}$ is a hydrogen atom where $P^3$ is a methacryloyloxy group, $R^{14}$ is a hydrogen atom where $P^4$ is a methacryloyloxy group, $R^{15}$ is a hydrogen atom where $P^5$ is a methacryloyloxy group, and $R^{16}$ is a hydrogen atom where $P^6$ is a methacryloyloxy group.

4. An electrophotographic photosensitive member according to claim 1, wherein the polymer is obtainable by the polymerization of a composition comprising:

the compound represented by the formula (1), and at least one compound selected from the group consisting of a compound represented by the following formula (B) and a compound represented by the following formula (C); and (B)

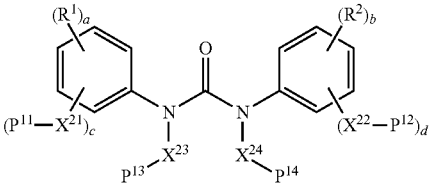

(C)

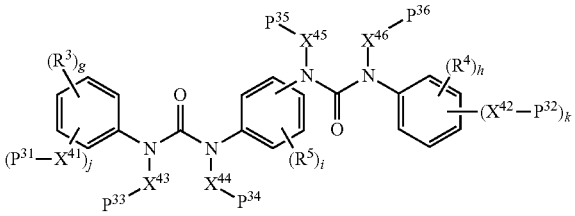

wherein, in the formulas (B) and (C), $R^1$ to $R^5$ each independently represents a methyl group, an ethyl group, a n-propyl group, a methoxymethyl group, a trifluoromethyl group, a methoxy group, an ethoxy group, a propoxy group, a methoxymethoxy group, a trifluoromethoxy group, a trichloromethoxy group, a dimethylamino group, or a fluorine atom, $X^{21}$ to $X^{24}$ and $X^{41}$ to $X^{46}$ each independently represents an alkylene group, $P^{11}$ to $P^{14}$ and $P^{31}$ to $P^{36}$ each independently represents a hydrogen atom, or a methacryloyloxy group, at least one of the $P^{11}$ to $P^{14}$ is a methacryloyloxy group, at least one of the $P^{31}$ to $P^{36}$ is a methacryloyloxy group, a, b, g, and h each independently represents an integer number selected from 0 to 5, i represents an integer number selected from 0 to 4, and c, d, j, and k each independently represents 0 or 1.

5. An electrophotographic photosensitive member according to claim 1, wherein the surface layer further comprises at least one compound selected from the group consisting of a compound represented by the following formula (D), a compound represented by the following formula (E) and a compound represented by the following formula (F); and (D)

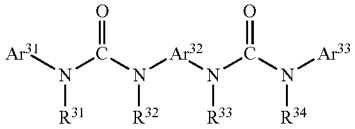

(E)

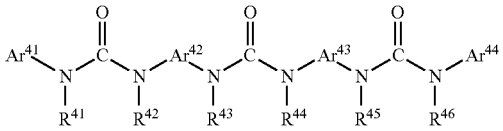

(F)

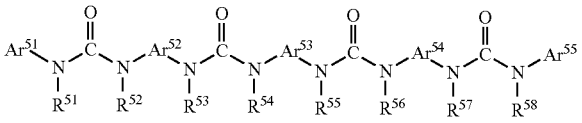

wherein, in the formulas (D), (E) and (F), $R^{31}$ to $R^{34}$, $R^{41}$ to $R^{46}$, and $R^{51}$ to $R^{58}$ each independently represents an alkyl group, $Ar^{32}$, $Ar^{42}$ to $Ar^{43}$, and $Ar^{52}$ to $Ar^{54}$ each independently represents an unsubstituted or substituted arylene group, $Ar^{31}$, $Ar^{33}$, $Ar^{41}$, $Ar^{44}$, $Ar^{51}$, and $Ar^{55}$ each independently represents an unsubstituted or substituted aryl group or a condensed ring, a substituent group of the substituted arylene group is an alkyl group, an alkoxy-substituted alkyl group, a halogen-substituted alkyl group, an alkoxy group, an alkoxy-substituted alkoxy group, a halogen-substituted alkoxy group, or a halogen atom, and a substituent group of the substituted aryl group is a carboxyl group, a cyano group, a dialkylamino group, a hydroxy group, an alkyl group, an alkoxy-substituted alkyl group, a halogen-substituted alkyl group, an alkoxy group, an alkoxy-substituted alkoxy group, a halogen-substituted alkoxy group, a nitro group, a halogen atom.

6. An electrophotographic photosensitive member according to claim 1, wherein the surface layer further comprises a quinone derivative consisting of one or both of:

a compound represented by the following formula (G), and a compound represented by the following formula (H), wherein the content of the quinone derivative in the surface layer is not less than 5 ppm and not more than 1500 ppm relative to the total mass of the polymer;

(G)

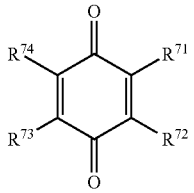

(H)

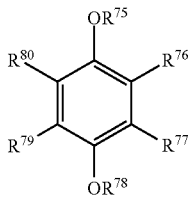

wherein, in the formulas (G) and (H), $R^{71}$ to $R^{74}$, $R^{76}$, $R^{77}$, $R^{79}$, and $R^{80}$ each independently represents a hydrogen atom, a hydroxy group, an unsubstituted or substituted alkyl group, an unsubstituted or substituted aryl group, or an unsubstituted or substituted alkoxy group, at least one of the $R^{71}$ and $R^{74}$ is a hydrogen atom, a methyl group, or a hydroxy group, at least one of the $R^{72}$ and $R^{73}$ is a hydrogen atom, a methyl group, or a hydroxy group, at least one of the $R^{76}$ and $R^{80}$ is a hydrogen atom, a methyl group, or a hydroxy group, at least one of the $R^{77}$ and $R^{79}$ is a hydrogen atom, a methyl group, or a hydroxy group, $R^{75}$ and $R^{78}$ each independently represents a hydrogen atom, an unsubstituted or substituted alkyl group, or an unsubstituted or substituted aryl group, and at least one of the $R^{75}$ and $R^{78}$ is a hydrogen atom.

7. An electrophotographic photosensitive member according to claim 6, wherein the compound represented by the formula (H) is a hydroquinone monomethyl ether.

8. A method of producing the electrophotographic photosensitive member according to claim 1, wherein the method comprises the following steps of:

forming a coat for the surface layer by the use of a surface-layer coating solution comprising the compound represented by the formula (1), and forming the surface layer by the polymerization of the compound represented by the formula (1) in the coat.

9. A method of producing the electrophotographic photosensitive member according to claim 8, wherein the polymerization of the compound represented by the formula (1) is effected by irradiating the coat with an electron beam.

10. A process cartridge detachably attachable to a main body of an electrophotographic apparatus, wherein the process cartridge integrally supports:

the electrophotographic photosensitive member according to claim 1, and at least one device selected from the group consisting of a charging device, a developing device, a transferring device, and a cleaning device.

11. An electrophotographic apparatus comprising:

the electrophotographic photosensitive member according to claim 1;

a charging device;

an exposure device;

a developing device; and a transferring device.

* * * * *